United States Patent [19]

Herber et al.

[11] 3,968,320

[45] July 6, 1976

[54] DYE SOLVENTS FOR PRESSURE-SENSITIVE RECORD MATERIAL

[75] Inventors: John F. Herber, St. Louis; James K. Sears, Webster Groves, both of Mo.; Quentin E. Thompson, Belleville, Ill.

[73] Assignee: Monsanto Company, St. Louis, Mo.

[22] Filed: Aug. 30, 1973

[21] Appl. No.: 393,116

[52] U.S. Cl. ..... 428/537; 427/145; 427/149; 427/150; 427/261; 428/454

[51] Int. Cl.[2] ..... B41M 5/16

[58] Field of Search ..... 117/36.8, 36.2, 1.7; 427/145, 261, 150, 149; 428/488, 511, 454, 537

[56] References Cited

UNITED STATES PATENTS 2,394,688 2/1946 Heyman ..... 8/173

3,244,550 4/1966 Farnham et al. ..... 117/36.8 X

*Primary Examiner*—Thomas J. Herbert, Jr.

*Attorney, Agent, or Firm*—William H. Duffey

[57] ABSTRACT

Benzyl aryl ethers are useful solvents for chromogenic materials in preparing pressure-sensitive record material wherein a colorless or substantially colorless chromogen is reacted in the presence of a benzyl aryl ether solvent with an acidic sensitizing material to form a colored mark in a pattern determined by the application of localized pressure to the record material. The benzyl aryl ether solvents are heat stable and give particularly fast color development on phenolic resin coated papers.

15 Claims, No Drawings

DYE SOLVENTS FOR PRESSURE-SENSITIVE RECORD MATERIAL

BACKGROUND OF THE INVENTION

1. Field of the Invention

This invention relates to pressure-sensitive record materials and particularly to solvents for colorless dyes used in preparing such materials.

2. Description of the Prior Art

Conventional pressure-sensitive record materials comprise in combination marking fluid or dye and a solid coreactant which are deposited in substantially continuous coatings upon a dye carrying sheet and a dye receiving sheet, and which are separated by a physical barrier which is eliminated by the application of pressure. One such record material comprises a first sheet material containing a substantially continuous covering of pressure rupturable capsules containing as a marking fluid a solution of a chromogenic material in a solvent and a second sheet material containing in apposition to the capsules on the first sheet a continuous coating of a solid acidic sensitizing material which is reactive with the marking liquid to form a colored reaction product. The capsules containing the marking fluid are sufficient in number and volume to yield a continuous image pattern when the marking field is expelled from the capsules by pressure applied in an image pattern.

The marking fluid contained in the capsules of the first sheet can be any of a variety of liquid compositions provided they produce a colored mark when allowed to contact the solid coreactant. Generally desirable properties of the marking fluid are that it be easily encapsulated by conventional techniques, that it have good shelf life in the encapsulated form, and that it be stable at moderately elevated temperatures. It is also important that the mark produced as the result of the reaction between the marking fluid and the solid coreactant develop rapidly, be fade resistant and be resistant to bleeding or feathering as a result of capillary action or other surface phenomena.

The marking fluid is preferably a solution of a colorless or substantially colorless chromogenic material and solvent which develops color upon contact and reaction with the solid coreactant or sensitizing material. Such materials have the advantage of not discoloring hands, clothing or other surfaces if accidentally ruptured thereon.

Solid coreactants or sensitizing materials for such marking fluids include finely divided acidic compounds which are also colorless or nearly colorless in their natural form. Commonly used materials include organic polymers and inorganic clays which are applied to the paper surface in any suitable paper coating binder material such as starch, casein, polymer, or latex.

The solvent functions to provide a carrier for the chromogen and a medium for the reaction between the chromogen and the acidic sensitizing material. As a general practice, the chromogen is dissolved in the solvent to form a solution which may be encapsulated and applied as a coating to one surface of the record paper. The solvent must be capable of holding the chromogen in solution within the capsule, of carrying the marking liquid to the sensitized paper when the capsule is ruptured, and of promoting or at least not inhibiting color development with the solid coreactant.

In addition, since inadvertent rupture of the capsule is possible by careless handling, the solvent must be an innocuous material, noninjurious to skin, clothing or environment.

The solvent is an important factor in determining the performance of the record transfer material in terms of stability of the paper to heat and storage time, rate of color development, extent of color development, and durability of image. The prior art, however, has paid little attention to the subject of solvents and has concentrated instead on improvements in chromogens and sensitizing materials utilizing solvents taken from a limited number of compounds such as petroleum oils and distillates, toluene, perchloroethylene, xylene, chlorinated paraffins, chlorinated diphenyls, alkylated diphenyls, hydrogenated terphenyls, dioctyl phthalate and methyl salicylate. Although many of these solvents have given good results in the past applications, the full potential of the solvent as a positive contributor to the performance of the record transfer material has not heretofore been fully realized.

It is accordingly an object of the present invention to provide solvents and classes of solvents which are superior to those presently known for use in record transfer materials and which make a positive contribution to the performance of the paper. Further objects of the invention will be apparent from the ensuing description and examples.

SUMMARY

Improved solvents for chromogenic materials used in pressure-sensitive record materials are benzyl aryl ethers represented by the structure:

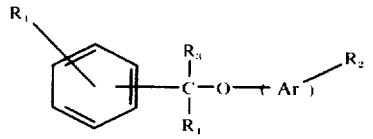

wherein Ar is an aryl radical selected from the group consisting of phenyl, tolyl, xylenyl, naphthyl and biphenylyl; $R_1$, $R_3$ and $R_4$ are individually hydrogen or an alkyl group having from 1 to 4 carbon atoms; and $R_2$ is hydrogen or from 1 to 4 alkyl groups, alike or unlike, the total carbon atom content of $R_2$ being not greater than 6.

These solvents give rapid color development and excellent color intensity on phenolic resin receiver sheets, with less odor than many prior art compounds known for this use.

DESCRIPTION OF PREFERRED EMBODIMENTS

The pressure-sensitive recording paper systems utilizing colorless dye solutions comprising chromogens and the improved solvents of the present invention may be prepared according to well known conventional procedures. Descriptions of methods for preparing both the dye carrying paper and the receiving paper of either the resin coated or clay coated type are to be found in the literature and such methods do not constitute a part of the present invention. Indeed, the solvents disclosed herein may generally be substituted for conventional dye solvents in order to produce improved recording paper systems according to such conventional procedures.

The solvents of the present invention are preferably utilized in combination with one or more of several conventional chromogenic materials of normally colorless form. One such class of chromogens comprises colorless aromatic double bond organic compounds which are converted to a more highly polarized conjugated and colored form when reacted with an acidic sensitizing material. A particularly preferred class of chromogens include compounds of the phthalide type such as crystal violet lactone which is 3,3-bis(p-dimethylaminophenyl)-6-dimethylaminophthalide and malachite green lactone which is 3,3-bis(p-dimethylaminophenyl)phthalide. Other phthalide derived chromogenic materials include 3,3-bis(p-m-dipropylaminophenyl)phthalide, 3,3-bis(p-methylaminophenyl)phthalide, 3-(phenyl)-3-(indole-3-yl)-phthalides such as 3-(p-dimethylaminophenyl)-3-(1,2-dimethylindol-3-yl)phthalide, 3,3-bis(phenylindol-3-yl)phthalides such as 3,3-bis(1,2-dimethylindol-3-yl)phthalide, 3-(phenyl)-3-(heterocyclic-substituted)phthalides such as 3-(p-dimethylaminophenyl)-3-(1-methylpyrr-2-yl)-6-dimethylaminophthalide, indole and carbazole-substituted phthalides such as 3,3-bis(1,2-dimethylindol-3-yl)-5-dimethylaminophthalide and 3,3-bis(9-ethylcarbazol-3-yl)-5-dimethylaminophthalide, and substituted indole phthalides such as 3-(1,2-dimethylindol-3-yl)-3-(2-methylindol-3-yl)phthalide.

Other chromogenic dye compounds also useful in the practice of this invention include indole substituted pyromellitides such as 3,5-bis-(p-diethylaminophenyl)-3,5-bis(1,2-dimethylindol-3-yl)pyromellitide, 3,7-bis-(p-diethylaminophenyl)-3,7-bis-(1,2-dimethylindol-3-yl)pyromellitide, 3,3,7,7-tetrakis-(1,2-dimethylindol-3-yl)pyromellitide and 3,3,5,5-tetrakis-(1,2-dimethylindol-3-yl)pyromellitide; and leucauramines and substituted leucauramines such as p-xylyl-leucauramine and phenylleucauramine. Also included are orthohydroxybenzoacetophenone, 2,4-bis[p-(p-dimethylaminophenylazo)aniline]-6-hydroxy-symtriazine, N,3,3-trimethylindolinobenzospiropyrans, and N,3,3-trimethylindolino-$\beta$-naphthospiropiranes.

An auxiliary coloring agent can be employed with the above chromogens to provide fade resistance where fading is a problem. Many phthalide compounds such as crystal violet lactone for example, are characterized by rapid color development with a normal tendency to fade during the course of time. One suitable auxiliary coloring agent is benzoyl leuco methylene blue which oxidizes when released on the paper to slowly form a permanent blue color. The combination of a phthalide chromogen and such a colorless oxidizable auxiliary coloring agent provides a composition having both rapid color development and fade resistance.

The solvents of this invention are benzyl aryl ethers represented by the structure:

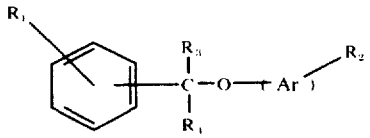

wherein Ar is an aryl radical selected from the group consisting of phenyl, tolyl, xylenyl, naphthyl and biphenylyl; $R_1$, $R_3$ and $R_1$ are individually hydrogen or an alkyl group having from 1 to 4 carbon atoms; and $R_2$ is hydrogen or from 1 to 4 alkyl groups, alike or unlike, the total carbon atom content of $R_2$ being not greater than 6.

The solvents of this invention are benzyl aryl ethers wherein the aryl group is alkyl-substituted. Preferred solvents herein are isopropylphenyl benzyl ether, ethylphenyl benzyl ether, tolyl benzyl ether and xylenyl benzyl ether. Other exemplary solvents herein, not to be construed in a limiting sense, are tolyl-$\alpha$-methyl benzyl ether, tolyl cumyl ether, tolyl-2-methyl benzyl ether, tolyl-3-methyl benzyl ether and tolyl-4-methyl benzyl ether.

In a preferred dye solvent embodiment of the present invention, the $R_2$ group of the structural formula comprises one or more alkyl groups, alike or unlike, the total carbon atom content of $R_2$ being not greater than 4.

Surprisingly, it has been found that dibenzyl ether solvents exhibit comparatively slow color development. The reasons therefor are not fully understood.

The solvents of this invention which are liquids at room temperature may be used alone or in combination with diluents. Solvents which are solids or semisolids at room temperature must necessarily be used in combination with another material, hereinafter referred to as a diluent, in order to provide a mixture having the requisite degree of liquidity for use in pressure-sensitive recording paper systems. For purposes of this invention the term "diluent" includes both inert or substantially inert materials which are of little practical use along as dye solvents either because they have poor solvating power for the chromogen or because they act in some way to inhibit the development of color, as well as some more active materials such as aromatic organic compounds which may be useful by themselves as dye solvents.

Either type of diluent may be used in combination with the solvents of this invention. For example, a solvent may be admixed with from 0 to about 3 parts of a diluent for each part of solvent wherein the diluent is a mineral or vegetable oil, such as kerosene, paraffin oil, mineral spirits, castor oil, neat's-foot oil, sperm oil, lard oil, olive oil, soybean oil, cottonseed oil, coconut oil, or rapeseed oil, or an organic aryl compound such as aromatic naphtha, $C_{1-12}$ alkyl benzene, benzyl biphenyl, or $C_{1-6}$ alkylaryl indane. These diluents function to alter physical properties of the solvent such as viscosity or vapor pressure as may be desired for handling or processing considerations. The diluents may also serve to reduce the total cost of the solvent in the system and to enhance in some instances the performance of the solvent particularly with respect to speed of color development or resistance to fade.

The solvents may also contain certain additives specifically intended to alter or control the final properties of the fluid as for example viscosity control agents, vapor pressure control agents, freezing point depressants, odor masking agents, antioxidants, colored dyes and the like.

In a preferred embodiment of the present invention, the chromogenic material is dissolved in a selected solvent to form a marking liquid which is reactive with the acidic solid coreactant material. The acidic material can be any compound within the definition of a Lewis acid, i.e., an electron acceptor with reference to the chromogen, which promotes the polarization of the chromogen into a colored form. The solid acidic material further serves as an adsorbent of the marking fluid to receive the transferred image. Commonly used acidic materials include acid clays and acidic organic polymeric materials such as phenolic polymers, phenol-acetylene polymers, maleic acid-rosin resins, partially or wholly hydrolyzed styrene-maleic anhydride copolymers and ethylene-maleic anhydride copolymers, carboxy polymethylene and wholly or partially hydrolyzed vinyl methyl ether, maleic anhydride copolymer and mixtures thereof. Superior results are achieved herein with the phenolic type acidic materials. It was surprising and unexpected that the benzyl aryl ethers of this invention gave noticeably better results on phenolic resin coated paper as compared to other coatings and other solvents.

The effect of various solvents on the rate and extent of color development was determined in a laboratory procedure which consisted of preparing a marking fluid comprising a solution of a chromogen in the solvent to be tested, applying the fluid to a receiving paper coated with a phenolic resin coreactant material, and measuring the print speed and color intensity.

In the following examples the marking fluid was prepared by adding 0.6 grams of crystal violet lactone (CVL) to 10 grams of solvent with agitation and warming to 100°–120°C. if necessary to achieve solution. The solution was then cooled to room temperature, seeded with a few crystals of the chromogen, and allowed to stand for several days with occasional shaking to assure that the solution was not supersaturated.

The solvent/dye solution was thereupon saturated into a blotter. The blotter is daubed 7 times with a pencil eraser. The material on the pencil eraser, (approximately 1 microliter of the solvent/dye solution) is transferred to a phenolic resin receiver sheet and color intensity is measured.

A Macbeth digital read-out Reflection Densitometer was employed using filters for color. The optical density measurements are seen visually and are recorded on a Sanborn recorder which plots optical density versus time.

Print speed is defined herein as the time (in seconds) from injection of the solvent/dye solution until an optical density of 40 is achieved on the receiver sheet. It has been found difficult to visually distinguish color change above a value of 40.

Color intensity for each of the samples tested was derived from the recording at a defined elapsed time.

The results of tests evaluating representative solvent compositions are presented in Table I and illustrate the generally superior performance obtained with the solvents of this invention. The specific materials presented in the Table are for purposes of illustration only and the present invention is not to be limited thereto.

TABLE I

| PHENOLIC RESIN RECEIVER SHEET | | | |
|---|---|---|---|
| Solvent | Print Speed (Seconds) | % Color Development at "x" Time in Seconds | % |
| Isopropyl phenyl benzyl ether | 8.5 | x = 68 | 65 |
| Ethyl phenyl benzyl ether | 6.5 | x = 63 | 66 |
| o-Tolyl benzyl ether | 3 | x = 82 | 76 |
| Mixed tolyl benzyl ether | 6 | x = 75 | 66 |

Although a preferred embodiment of this invention comprises a two-sheet system wherein the acidic receiving material is carried by one sheet and a marking fluid comprising a chromogen and solvent is carried by a second sheet, the marking fluid being released onto the acidic material by the application of pressure, the invention is not limited to such systems alone. The only essential requirement for a pressure-sensitive recording system is that the chromogen and the acidic sensitizing material be maintained in a separate or unreactive condition until pressure is applied to the system and that upon the application of pressure the chromogen and acidic material are brought into reactive contact. Thus it is possible to have the chromogen and acidic material present in a dry and unreactive state on a common carrier and to have the solvent alone carried on a separate sheet whereupon the application of pressure would release the solvent into the chromogen-acidic material mixture and promote localized reaction and color development. Obviously, many other arrangements, configurations and relationships of the solvent and the mark forming materials with respect to their encapsulation and location on the supporting sheet or webs can be envisioned, and such arrangements are within the scope of the present invention. For example, it is possible to coat a single paper or support member with all the components of this system to form a single self-contained unit which can be marked by the movement of a stylus or other pressure imparting means upon the surface of the paper. Such papers are particularly useful for use in inkless recording instruments.

Thus, the present invention encompasses pressure-sensitive recording paper systems utilizing a chromogenic material, an acidic sensitizing material, and a solvent comprising benzyl aryl ethers of the type defined herein. Many variations and combinations in the application of these reactants to prepare pressure-sensitive recording paper systems will be apparent to and within the knowledge of those skilled in the art and will depend upon such factors as the type of chromogenic material selected, the nature of the coating to be applied and its method of application, the number of supporting substrates employed, and the intended application of the system. Accordingly, the present invention is not to be limited by the specific details presented in the preceding descriptions and examples.

The embodiments of the invention in which an exclusive property or privilege is claimed are defined as follows:

1. A pressure-sensitive recording paper system comprising a. a supporting web or sheet material, b. mark forming components arranged in contiguous juxtaposition and supported by said sheet material, said components comprising a chromogenic material and an electron accepting material of the Lewis acid type reactive with said chromogenic material to produce a mark when brought into reactive contact, and c. a pressure releasable liquid solvent for said chromogenic mark forming component, said solvent comprising a benzyl aryl ether represented by the structure

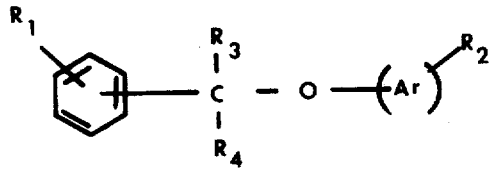

wherein Ar is an aryl radical selected from the group consisting of phenyl, tolyl, and xylenyl; $R_1$, $R_3$ and $R_4$ are individually hydrogen or an alkyl group having from 1 to 4 carbon atoms; and $R_2$ is hydrogen or from 1 to 4 alkyl groups, alike or unlike, the total carbon atom content of $R_2$ being not greater than 6.

2. A system of claim 1 wherein the electron accepting material of the Lewis acid type is a phenolic polymer.

3. A system of claim 2 wherein the total carbon atom content of $R_2$ is not greater than 4.

4. A system of claim 1 wherein the chromogenic material is dissolved in the liquid solvent prior to bringing said chromogenic material and said electron accepting material into reactive contact.

5. A system of claim 1 wherein the mark forming components and the liquid solvent are present on a single support sheet.

6. A system of claim 1 wherein the chromogenic material comprises a phthalide compound.

7. A pressure-sensitive recording paper system comprising a. a first support web or sheet material having disposed thereon a coating of a pressure releasable marking fluid, and b. a second supporting web or sheet material having disposed thereon a coating of an electron accepting material of the Lewis acid type arranged in contiguous juxtaposition with the coating on said first supporting material, said marking fluid comprising a liquid solvent and a colorless or substantially colorless chromogenic material dissolved therein, said chromogenic material being reactive with said Lewis acid type material to produce a colored mark and said solvent comprising a benzyl aryl ether represented by the structure

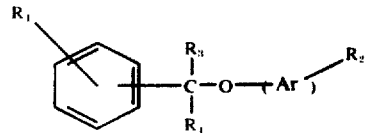

wherein Ar is an aryl radical selected from the group consisting of phenyl, tolyl, and xylenyl, $R_1$, $R_3$ and $R_4$ are individually hydrogen or an alkyl group having from 1 to 4 carbon atoms; and $R_2$ is hydrogen or from 1 to 4 alkyl groups, alike or unlike, the total carbon atom content of $R_2$ being not greater than 6.

8. A system of claim 7 wherein the electron accepting material of the Lewis acid type is a phenolic polymer.

9. A system of claim 8 wherein the total carbon atom content of $R_2$ is not greater than 4.

10. A system of claim 7 wherein the chromogenic material is dissolved in the liquid solvent prior to bringing said chromogenic material and said electron accepting material into reactive contact.

11. A system of claim 7 wherein the chromogenic material comprises a phthalide compound.

12. A method of marking on a substrate by developing a color from colorless or substantially colorless chromogenic compounds which comprises contacting said chromogenic compounds and an electron accepting material of the Lewis acid type in the presence of a liquid solvent comprising a benzyl aryl ether represented by the structure

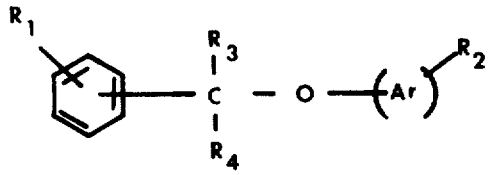

wherein Ar is an aryl radical selected from the group consisting of phenyl, tolyl, and xylenyl, $R_1$, $R_3$ and $R_4$ are individually hydrogen or an alkyl group having from 1 to 4 carbon atoms; and $R_2$ is hydrogen or from 1 to 4 alkyl groups, alike or unlike, the total carbon atom content of $R_2$ being not greater than 6.

13. A method of claim 12 wherein the electron accepting material of the Lewis acid type is a phenolic polymer.

14. A method of claim 13 wherein the total carbon atom content of $R_2$ is not greater than 4.

15. A method of claim 12 wherein the chromogenic material comprises a phthalide compound.

* * * * *